US006446620B1

(12) United States Patent
Summers et al.

(10) Patent No.: US 6,446,620 B1
(45) Date of Patent: Sep. 10, 2002

(54) BOWSTRING SILENCER

(75) Inventors: Gregory E. Summers, 105 Overlink Dr., Lynchburg, VA (US) 24503; Marc T. Rentz, Madison Heights, VA (US)

(73) Assignee: Gregory E. Summers, Lynchburg, VA (US)

( * ) Notice: Subject to any disclaimer, the term of this patent is extended or adjusted under 35 U.S.C. 154(b) by 0 days.

(21) Appl. No.: 09/760,722

(22) Filed: Jan. 17, 2001

(51) Int. Cl.[7] ..... F41B 5/14
(52) U.S. Cl. ..... 124/92
(58) Field of Search ..... 124/90, 91, 92

(56) References Cited

U.S. PATENT DOCUMENTS 3,059,629 A * 10/1962 Stinson
3,584,615 A 6/1971 Stinson
3,612,029 A * 10/1971 Carroll et al.
3,756,214 A * 9/1973 Christen
3,837,327 A 9/1974 Saunders et al.
4,080,951 A * 3/1978 Bateman ..... 124/92
5,016,604 A 5/1991 Tilby ..... 124/92
5,715,805 A 2/1998 Summers et al. ..... 124/91
6,237,584 B1 * 5/2001 Sims ..... 124/92

* cited by examiner

*Primary Examiner*—John A. Ricci
(74) *Attorney, Agent, or Firm*—Nixon & Vanderhye P.C.

(57) ABSTRACT

A bowstring silencer includes a weight component and a silencer component, the silencer component secured to the weight component and including a plurality of relatively flexible projections; the weight component adapted to be clamped about a bowstring. The weight component may be formed as a pair of generally semi-spherical ball halves that are secured together about the silencer component and a bowstring by suitable fasteners.

16 Claims, 3 Drawing Sheets

BOWSTRING SILENCER

TECHNICAL FIELD

This invention relates generally to archery bow construction, and more specifically, to a bowstring silencer that increases arrow speed while silencing the bow.

BACKGROUND

Bowstrings tend to generate noise when an arrow is fired from the bow. This noise is caused primarily by bowstring vibration. Silencers have been utilized to dampen the vibrations of bowstrings, examples being found in U.S. Pat. Nos. 5,016,604; 3,837,327; 3,612,029; and 3,584,615. It has been observed, however, that known bowstring silencers may cause arrow speed loss, an undesirable consequence of dampening the bowstring vibrations.

Thus, there is a need for a bowstring silencer that does not cause loss of arrow speed, and/or a silencer that actually increases arrow speed while silencing the bow.

SUMMARY OF THE INVENTION

The present invention provides a bowstring silencer that not only silences the bowstring but also increases arrow speed. The increase in arrow speed is provided by adding a weight, or "speed ball," to the silencer, and attaching one or more silencers to a specific area of the bowstring. In a preferred arrangement, two silencers are located near the cams at respective opposing ends of the bow limbs, creating a pendulum effect to maintain all shot power forces in a forward assimilate direction. The speed ball is comprised of two half ball shapes, each with an internal half groove that together form a through-bore that enables the speed ball to be clamped about, and thus fixed, to the bowstring. The silencing function is achieved through air resistance caused by the incorporation of flexible appendages, or simulated "spider legs" (herein, the "spider"), bringing a reduction of the bowstring resonance and vibration. The spider is preferably also sandwiched between the ball halves. Preferably, the spider material is a hypolon or rubber coated fabric that prevents water absorption while providing longer product life span.

Speed and silencing results vary, with maximum speed achieved when using speed balls only, and maximum silence achieved when using two spiders on each speed ball. In a preferred arrangement, two speed balls are attached to the bowstring, and each utilizes two of the spiders.

Accordingly, in one aspect, the present invention relates to a bowstring silencer comprising a weight component and a silencer component, the silencer component secured to the weight component and including a plurality of relatively flexible projections; the weight component adapted to be clamped about a bowstring.

In another aspect, the invention relates to a bowstring silencer comprising a weight and at least one silencer component secured to the weight and including a plurality of relatively flexible projections; wherein the weight comprises a pair of half weight components, and wherein each half weight component is formed with an internal bowstring half groove, the half weight components including means for fastening the half weight components together, thereby enabling the half weight components to be clamped about a bowstring.

Other objects and advantages of the subject invention will become apparent from the detailed description that follows.

DETAILED DESCRIPTION OF THE DRAWINGS

Figure 1:
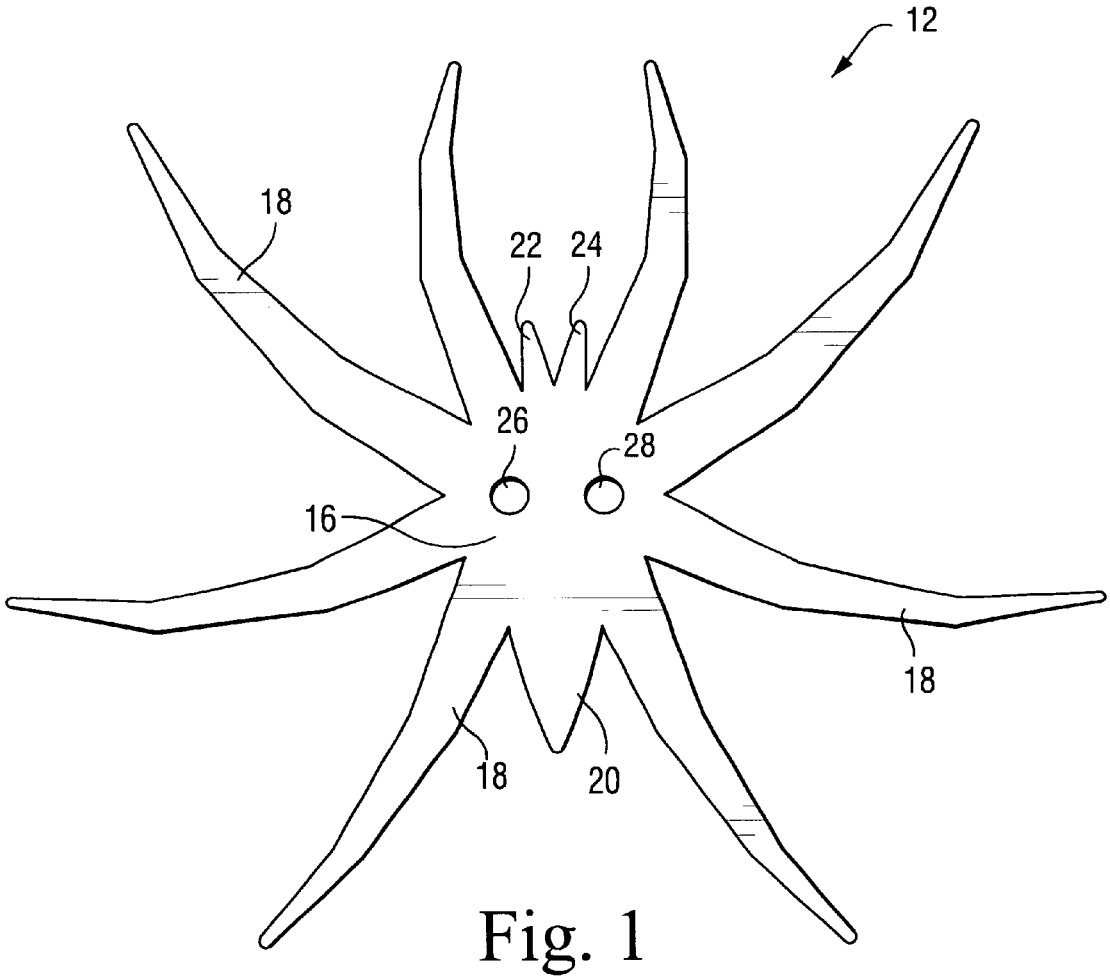
FIG. 1 is a side elevation of a spider portion of a silencer in accordance with an exemplary embodiment of the invention.
Figure 4:
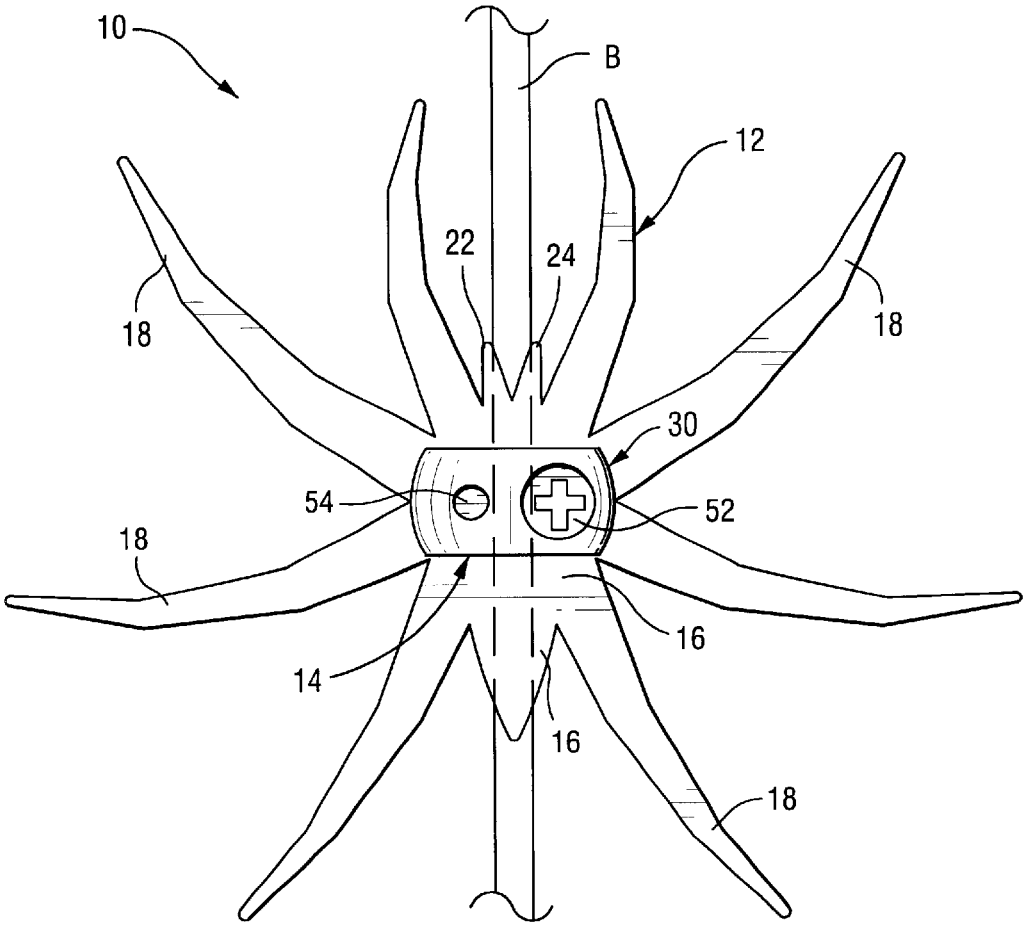
FIG. 4 is a side elevation of a silencer in accordance with an exemplary embodiment of the invention, attached to a bow string.

With reference initially to FIG. 4, the silencer 10 in accordance with this invention includes a spider component 12, and a weight or speed ball component 14. The silencer 10 is adapted to be secured to a bow string B, preferably in those areas of the bowstring near the cams at the opposing ends of the bow limbs. With specific reference to FIG. 1, the spider 12 is formed with a center body portion 16 and a plurality of simulated spider limbs or legs 18 extending generally radially therefrom. The spider portion also includes simulated body portion 20 and antennae or other simulated body portions 22, 24. A pair of fastener holes 26 and 28 are formed in the center body portion 16. Spider portion material is a hypolon or other rubber coated fabric, preferably a woven nylon fabric. The rubber coating prevents water absorption which causes weight gain that alters shot accuracy, while the nylon provides for a longer product life. The natural flexibility of the spider, and the arrangement of the legs and other projections, causes air resistance that reduces bowstring vibration as described further herein. It will be appreciated that the "spider" shape is exemplary only, and that other shapes may be employed as well, for example, a sunburst or other shape that includes multiple generally radially extending projections.

Figure 3:
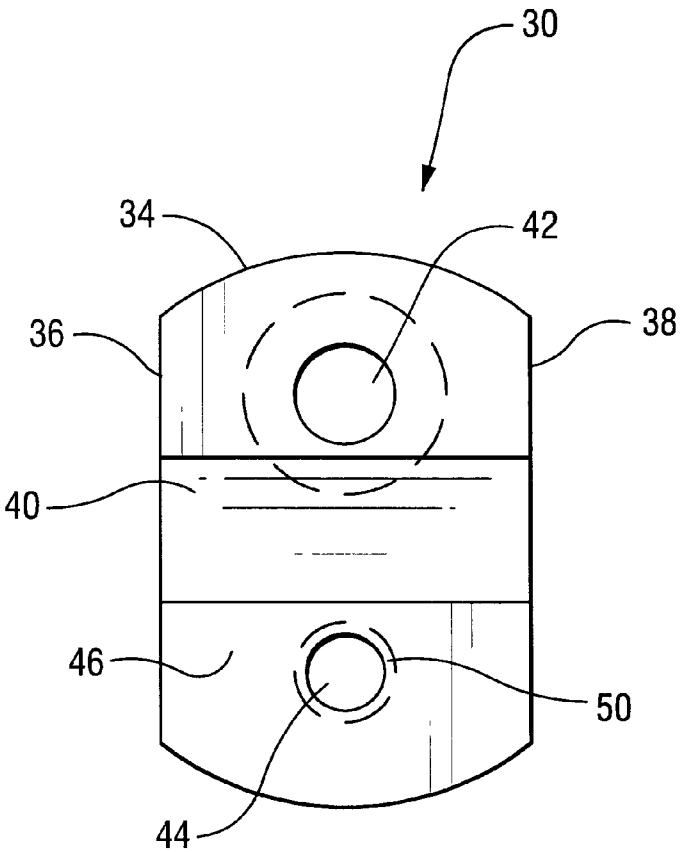
FIG. 3 is an end view of the ball half shown in FIG. 2.
Figure 2:
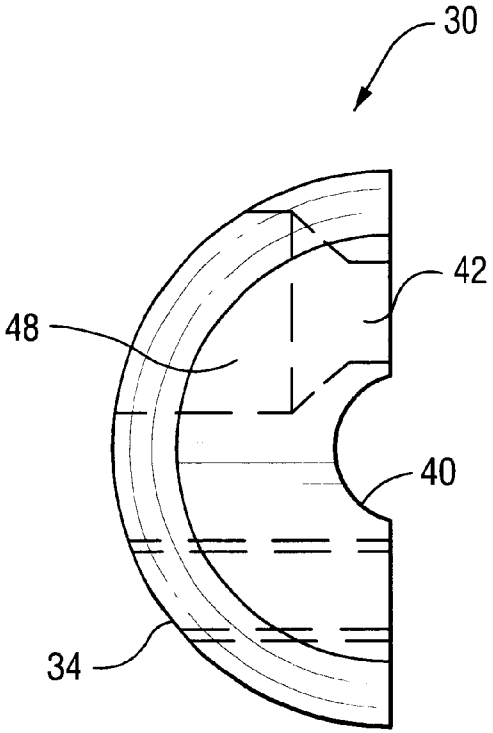
FIG. 2 is a side elevation of one half of a speed ball in accordance with an exemplary embodiment of the invention.
Figure 5:
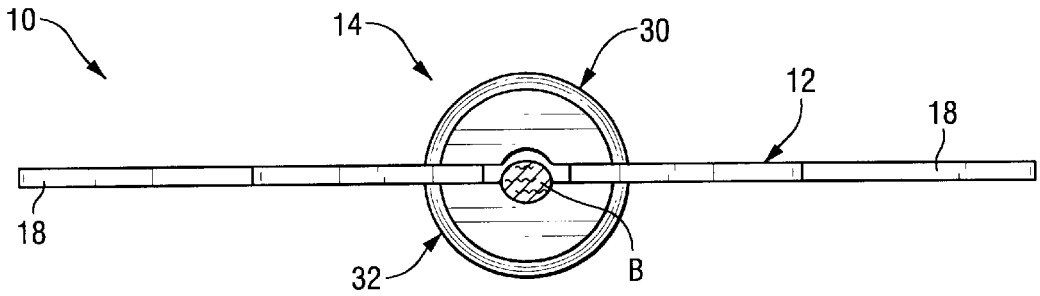
FIG. 5 is an end view of the silencer shown in FIG. 4.

The weight or speed ball portion 14 of the silencer includes two half weight components formed substantially as mirror image generally semi-spherical ball halves, one ball half 30 illustrated in FIGS. 2 and 3, the other ball half 32 shown in FIG. 5. The ball half 30 includes a generally semi-spherical surface 34 with two flat truncated side surfaces 36, 38. Along the interior of the ball half 30, there is a bowstring half groove 40 extending transversely of the flat surfaces 36, 38. In addition, fastener holes 42, 44 pass through the ball half 30 intersecting a flat surface 46 on either side of the bow string half groove 40. In the absence of a spider, the surface 46 would engage a similar surface on ball half 32 when the ball halves are engaged about a bowstring.

Hole 42 is countersunk at 48, and is thus adapted to receive the head of a threaded machine screw or other fastener. Hole 44, on the other hand, is not countersunk, but is threaded as shown at 50. It will be appreciated that when the mirror image ball half 32 is mated with the ball half 30, fastener screws 52, 54 (FIG. 4) may be inserted from opposite directions into threaded apertures on the respective ball halves. This speed ball design is essentially identical to that described in commonly owned U.S. Pat. No. 5,680,851. The weight or speed ball may be comprised of aluminum or plastic or other suitable material.

Referring back to FIG. 4, as well as FIG. 5, it will be appreciated that the spider 12 is preferably located between the ball halves with a bow string B located within the bow string grooves 40. The two half grooves form a hole through the speed ball, with a diameter sufficiently small to insure good clamping action on the bowstring when the ball halves 30, 32 are fastened together. With the spider 12 also firmly clamped between the respective ball halves, it will be appreciated that the area between holes 26, 28 essentially conforms to the shape of one of the half grooves 40 (best seen in FIG. 4).

In a preferred arrangement, two silencers 10 of the type described herein are utilized to add weight placement to specific areas on the bow string, preferably one near each of the cams at opposite ends of the bow limbs. One or two spider components may be assembled with each speed ball. Two spiders provide maximum string resonance reduction and vibration dampening and thus silencing. The additional weight provided by the speed ball effectively collects some of the displaced power forces transferred to the bow string from the cams and bow limbs, and returns the displacement of those forces in a more uniform forward pendulum motion direction, creating an increase in arrow speed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A bowstring silencer comprising a weight component and a silencer component, said silencer component secured to said weight component and including a plurality of relatively flexible projections; said weight component adapted to be clamped about a bowstring, wherein said weight component comprises a pair of substantially semi-spherical ball halves.

2. The bowstring silencer of claim 1 wherein each ball half is formed with an internal bowstring half groove.

3. The bowstring silencer of claim 2 wherein said silencer component is clamped between said pair of ball halves.

4. The bowstring silencer of claim 1 wherein said pair of ball halves are secured by a pair of screw fasteners.

5. The bowstring silencer of claim 1 wherein said weight component is metal or plastic.

6. The bowstring silencer of claim 1 wherein said silencer component is spider-shaped, with said plurality of relatively flexible projections shaped as simulated spider legs.

7. A bowstring silencer comprising a weight component and a silencer component, said silencer component secured to said weight component and including a plurality of relatively flexible projections; said weight component adapted to be clamped about a bowstring, wherein said silencer component comprises a rubber coated fabric.

8. The bowstring silencer of claim 7 wherein said silencer component is spider-shaped, with said plurality of relatively flexible projections shaped as simulated spider legs.

9. A bowstring silencer comprising a weight component and a silencer component, said silencer component secured to said weight component and including a plurality of relatively flexible projections; said weight component adapted to be clamped about a bowstring, wherein said weight component is metal or plastic, and wherein said silencer component comprises a rubber coated fabric.

10. The bowstring silencer of claim 9 wherein said silencer component is spider-shaped, with said plurality of relatively flexible projections shaped as simulated spider legs.

11. A bowstring silencer comprising a weight and at least one silencer component secured to said weight and including a plurality of relatively flexible projections; wherein said weight comprises a pair of half weight components, and wherein each half weight component is formed with an internal bowstring half groove, said half weight components including means for fastening said half weight components together, thereby enabling said half weight components to be clamped about a bowstring, and further wherein said silencer component is located between said half weight components.

12. The bowstring silencer of claim 11 wherein said silencer component is spider-shaped, with said plurality of relatively flexible projections shaped as simulated spider legs.

13. A bowstring silencer comprising a weight and at least one silencer component secured to said weight and including a plurality of relatively flexible projections; wherein said weight comprises a pair of half weight components, and wherein each half weight component is formed with an internal bowstring half groove, said half weight components including means for fastening said half weight components together, thereby enabling said half weight components to be clamped about a bowstring, and further wherein a pair of silencer components are sandwiched between said pair of half weight components.

14. The bowstring silencer of claim 13 wherein said silencer component is spider-shaped, with said plurality of relatively flexible projections shaped as simulated spider legs.

15. A bowstring silencer comprising a weight and at least one silencer component secured to said weight and including a plurality of relatively flexible projections; wherein said weight comprises a pair of half weight components, and wherein each half weight component is formed with an internal bowstring half groove, said half weight components including means for fastening said half weight components together, thereby enabling said half weight components to be clamped about a bowstring, and further wherein each half weight component is shaped substantially as a generally semi-spherical half ball.

16. The bowstring silencer of claim 15 wherein said silencer component is spider-shaped, with said plurality of relatively flexible projections shaped as simulated spider legs.

* * * * *